United States Patent [19]

Askew

[11] 4,268,965

[45] May 26, 1981

[54] MASONRY CLEANING TOOL

[76] Inventor: Henry E. Askew, 1249 S. 50th St., Birmingham, Ala. 35222

[21] Appl. No.: 125,290

[22] Filed: Feb. 27, 1980

[51] Int. Cl.[3] ..... B26B 23/00

[52] U.S. Cl. ..... 30/304; 145/2 R; 15/236 R

[58] Field of Search ..... 7/144, 145; 145/2 R, 145/29 R, 29 D; 30/168, 172, 304, 305; 15/236 R

[56] References Cited

U.S. PATENT DOCUMENTS

| | | | |
|---|---|---|---|
| 1,437,624 | 12/1922 | Tyler | 30/304 X |
| 1,467,949 | 9/1923 | Pershing | 30/304 |
| 2,335,150 | 11/1943 | Johnson | 30/168 X |
| 3,955,234 | 5/1976 | Roefaro | 30/172 X |

*Primary Examiner*—Jimmy C. Peters

[57] ABSTRACT

A hand tool for cleaning or chipping away matter from a rigid surface. The tool has a handle of suitable material and a metal head. There is a set of three blades on each end of the head and the blades are parallel to the length of the handle. Each set of blades is staggered and comprise a long blade, a medium blade and a short blade. Each set of blades is designed to strike a surface at an angle to provide maximum effect with all three blades striking simultaneously. The tool will strike three times as much area as would a single blade. The double set of blades are provided so the tool can be used effectively by a right handed or a left handed person. Further the double set of blades permit the handle to be removed and inserted into the opposite side of the head, thus the life of the tool may be doubled.

1 Claim, 2 Drawing Figures

MASONRY CLEANING TOOL

FIELD OF INVENTION

This invention relates to a new and useful improvement in the design of a hatchet-like tool for cleaning or chipping away unwanted matter from the surface of rigid material. In particular, it is believed its primary and immediate benefit will be in providing means of removing mortar and/or concrete from old bricks and/or concrete blocks that are to be salvaged for reuse.

DISCUSSION OF PRIOR ART

In most instances an ordinary hatchet is used to remove mortar from bricks that have been salvaged from a razed building or wall. This ordinary hatchet provides only one striking blade, or edge, therefore it requires many blows to a brick to clean said brick. Furthermore, and most importantly, the ordinary hatchet has a definite tendancy to spin or rotate in the operator's hand, as the brick is being struck at an angle. This is not only tiresome to the operator, but it is also very time comsuming to said operator. Another negative feature of the ordinary hatchet is that the blade is relatively thin. Thus when the hatchet is used for a purpose for which it is not intended, namely, cleaning bricks, it has a very short economical life, and furthermore requires frequent sharpening.

OBJECTS

The objects of this invention are to provide a manual tool for cleaning unwanted matter from a rigid surface in which said tool requires less effort, which is more durable, which will accomplish the task more speedily, and will cost less than other manual tools presently available for the same purpose.

The objects of the Brickmaster as stated above will be accomplished as follows.

The Brickmaster will require less effort because it is constructed with three blades, and will consequently strike three times as much area as would a single blade. It is important to note it is not the severity of the blow which is usually required to remove the foreign matter from a rigid surface, thus it would not require three times as much force as would a single blade. This may be illustrated by considering the removal of mortar from a brick, the chipping away of paint from the side of a ship, or the removal of scale from the interior of a large boiler. Most importantly, there would be no tendancy for the Brickmaster to spin in the operator's hand, as would a single-blade tool.

The Brickmaster will be more durable than a single-blade tool in that each blade of said Brickmaster will be required to strike only one third as many times to perform a specific task. Furthermore, the blades of the Brickmaster are thicker and are designed with a chisel point to strike at the maximum effective angle.

The Brickmaster will perform more efficiently because it is striking three times as much area with each blow, as would a single blade strike with each blow.

The Brickmaster will cost less per life-time of use because the six blades will be manufactured or cast as a unit tool, that is, the entire head of said Brickmaster will be a single unit, rather than six separate units, as would a single blade tool. Furthermore, the handle may be removed and inserted into the opposite side of the head of the Brickmaster, which would double the life of the Brickmaster when used exclusively by a right-handed or a left-handed operator.

Further objects and advantages of this invention will become apparent from a consideration of the drawings and ensuing descriptions thereof.

DRAWINGS

DESCRIPTION

Figure 1:
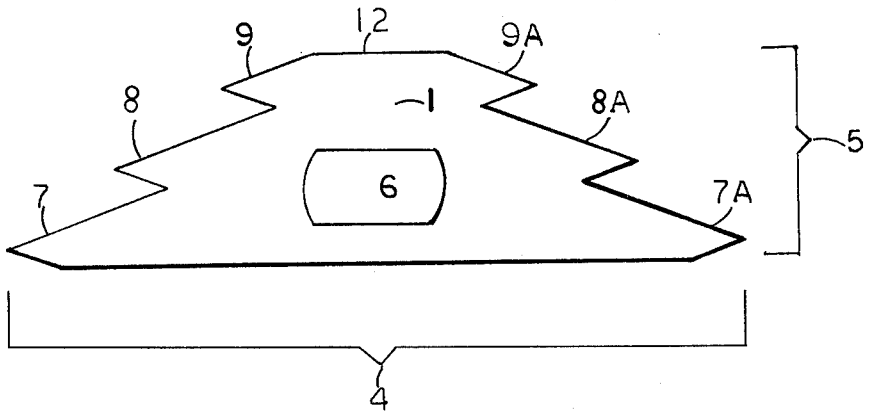
FIG. 1 is a view of the head of the Brickmaster, without the handle, looking directly into the hole provided for the handle.
Figure 2:
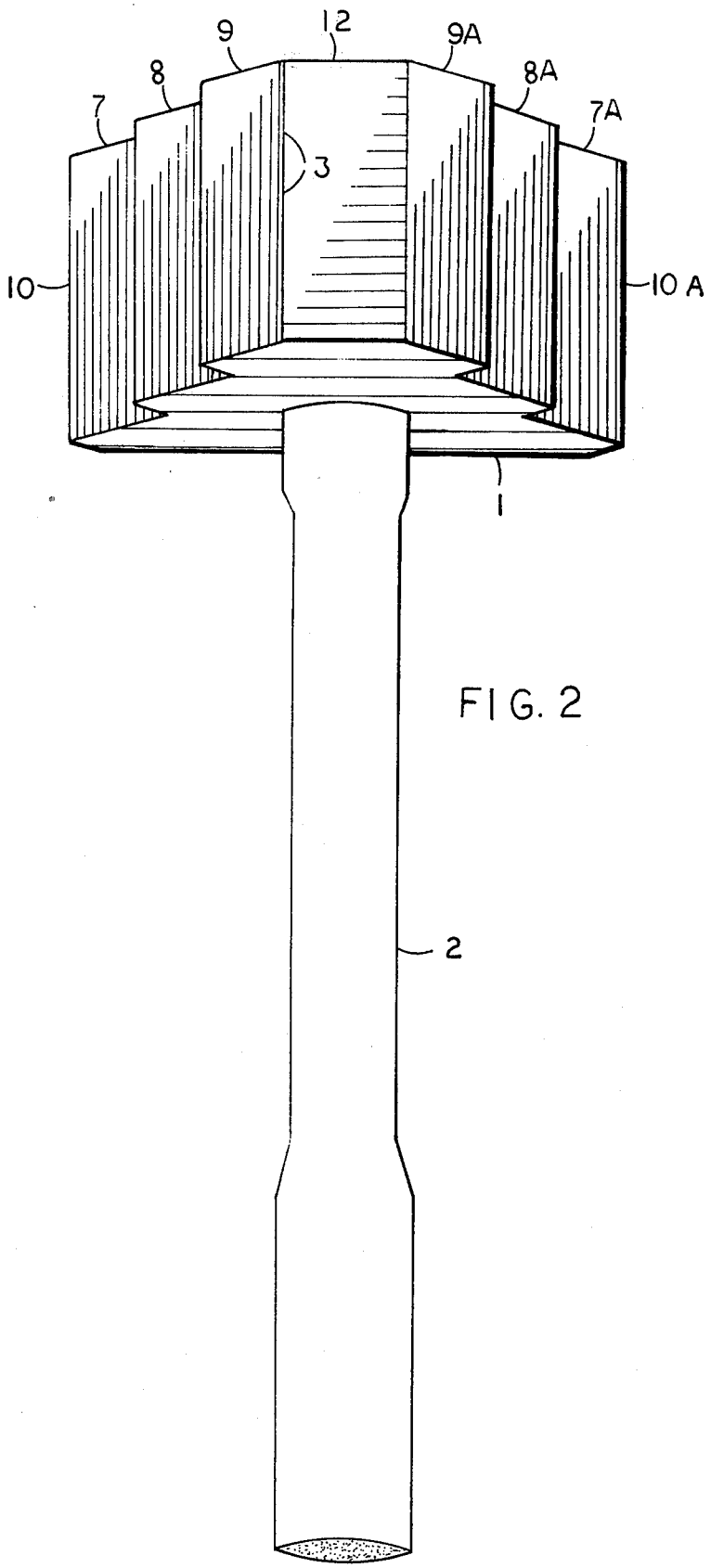
FIG. 2 is a perspective view of the entire Brickmaster from an approximate 45 degree angle above the butt of the handle, looking from said butt of said handle down toward the head of said Brickmaster, with the plane of the said blades parallel to the floor.

In essence, the Brickmaster is a double-bit hatchet-like tool with three staggered, straight-edged blades on each end of the head, with said blades being parallel to the length of the handle.

Referring now to the drawings in detail, it will be seen that the embodiment of the Brickmaster which has been illustrated comprises a six-bladed head 1 of suitable metal, from which extends a handle 2 of suitable material, with said handle 2 being approximately 11" in length.

The width 3 is considered that measurement of the head 1 on a line parallel to the length of the handle 2. The hole 6 through the head 1 of the Brickmaster to accomodate the handle 2 is to be 3" in extent, which is the same as the width 3.

The length 4 is the span of the head 1 as measured across the long blade 7 from cutting edge 10 to cutting edge 10A, on a line 90 degrees to a line running through the center of the length of the handle 2.

The thickness 5 is considered as that measurement from a point at the center of the plane of the outside surface of the long blade 7 to the same point at the center of the plane of the outside short surface 12 of the Brickmaster.

The head 1 of the Brickmaster is made of suitable metal and the handle 2 is made of suitable material. The head 1 has one long blade 7, one medium blade 8, and one short blade 9, on each end of said head 1. The reciprocal of each blade is referred to as 7A, 8A, and 9A, respectively.

The long, or primary blade 7 is 5" in length, as measured on a direct line from edge 10 of long blade 7 to edge 10A of long blade 7A. At a distance of $2\frac{1}{8}$" from the center of the span of the long blade 7 said blade 7 has a 20 degree angle away from the outer plane of the surface of said long blade 7, so that the final $\frac{3}{8}$" of the edge 10 of said blade 7 forms a chisel point.

From this point the long blade 7 recedes for $1\frac{1}{8}$" toward the center of head 1, on a 20 degree angle away from a plane parallel to the surface of long blade 7.

From this point the middle blade 8 begins and extends out for $\frac{3}{8}$" on a 20 degree angle away from a plane parallel to the surface of the long blade 7. From this point the middle blade 8 recedes $1\frac{1}{8}$" toward the center of the head 1 on a 20 degree angle away from a plane parallel to the surface of the long blade 7.

From this point the short blade 9 begins and extends out for $\frac{3}{8}$" on a 20 degree angle away from a plane parallel to the surface of the long blade 7. From this point the short blade 9 recedes for 21/32" toward the center of the plane of the head 1 on a 20 degree angle away from a plane parallel to the surface of the long blade 7.

From this point the short side 12 of head 1 begins and is parallel to the plane of the long blade 7, with said short side 12 being 1¼" in length.

The blades 7, 8, and 9, on each end of head 1 are constructed as described above and therefore are identical on each end of said head 1.

Through the width 3 of the head 1 of the Brickmaster extends a hole 6 to accomodate the handle 2. Said hole 6 approximates an oval ⅝" by 1".

The 1" span of the hole 6 is parallel to the plane of the surface of the long blade 7 and said hole 6 is balanced centroid in head 1.

The dimensions given in the foregoing are flexible, and said dimensions are given only to illustrate the necessity of constructing short, stubby blades, with a particular angle to form a chisel point which will strike at a particular angle. Changes in the size of the Brickmaster and the consequent changes in dimensions will be readily apparent to those skilled in the art, and it is not desired to limit the invention to the exact dimensions or descriptions as outlined above.

Furthermore, it is not the intent of this petition to restrict the use of the Brickmaster to the cleaning of bricks, although it is believed this would be the use which would provide maximum and immediate benefit. The Brickmaster may be used in any application which requires the chipping away of unwanted matter from a rigid surface.

OPERATION

The Brickmaster is to be held by hand and the rigid material to be cleaned is struck by the blades of said Brickmaster.

The three blades on one end of the Brickmaster are to stike the rigid surface simultaneously and at the same angle, thereby providing a rapid chipping or cleaning action.

The double set of blades is designed so that the Brickmaster may be used effectively with either the right hand or the left hand.

Should it be necessary to remove a large, single deposit of unwanted matter from the rigid material, the Brickmaster handle may be rotated 180 degrees in the operator's hand so that a single blade is presented to accomplish the removal of said single deposit.

I claim:

1. A hand-held tool for cleaning foreign matter from a rigid surface, said tool being comprised of a metal head with a handle of suitable material extending from the centroid of said head, with said head having on each end three short protuberances, or blades, with said blades arranged symmetrically so that each end mirrors the other end, the said blades being a long blade, then a medium length blade, then a short blade, with said blades being parallel to the length of said handle, and with the cutting edge of each said blade being formed with a chisel point.

* * * * *